US007182620B1

(12) United States Patent
Ju

(10) Patent No.: US 7,182,620 B1
(45) Date of Patent: Feb. 27, 2007

(54) BUCKLING STRUCTURE AND AN ELECTRICAL CONNECTOR ELEMENT USING THE SAME

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/401,908

(22) Filed: Apr. 12, 2006

(51) Int. Cl.
*H01R 13/62* (2006.01)

(52) U.S. Cl. ..... 439/331

(58) Field of Classification Search ..... 439/331, 439/342, 353–357
See application file for complete search history.

(56) References Cited

U.S. PATENT DOCUMENTS 7,021,954 B2 * 4/2006 Gattuso et al. ..... 439/342
7,033,198 B2 * 4/2006 Chiang ..... 439/331
7,101,209 B2 * 9/2006 Yates et al. ..... 439/331
7,121,844 B2 * 10/2006 Ma ..... 439/73
7,128,593 B2 * 10/2006 Ma ..... 439/331
7,134,898 B2 * 11/2006 Ma ..... 439/342

* cited by examiner

*Primary Examiner*—Khiem Nguyen
(74) *Attorney, Agent, or Firm*—Rosenberg, Klein & Lee

(57) ABSTRACT

A buckling structure includes a buckling part having a buckling point. There is a waving point located in the inside of the buckling point. The buckling point rotates with the waving point to be operated between a buckling status and an opening status. An electrical connector element includes an electrical connector and an absorbed cover assembled on the electrical connector. The absorbed cover has a first wedged-hook that can wedge and fasten to the electrical connector. The first wedged-hook includes a buckling part having a buckling point. There is a waving point located in the inside of the buckling point. The buckling point rotates with the waving point to be operated between a buckling status and an opening status.

6 Claims, 5 Drawing Sheets

BUCKLING STRUCTURE AND AN ELECTRICAL CONNECTOR ELEMENT USING THE SAME

BACKGROUND OF THE INVENTION

1. Field of the Invention

The present invention relates to a buckling structure and an electrical connector element using the same.

2. Description of the Related Art

An electrical connector is used for linking a chip module with a circuit board. It is usually composed of a metal base, a metal cover, a rod, and an insulating body receiving a plurality of conducting pins. The metal base of the electrical connector has a square frame structure and the insulating body is received in the metal base. Via the conducting pins in the insulating body (or solder balls under the conducting pins), the electrical connector is assembled on the circuit board using a welding method. In order to assemble the electrical connector automatically, a vacuum-absorbing device is used for absorbing the electrical connector onto the circuit and making the pins on the electrical connector align to the welding holes or conducting flakes. Then, the electrical connector is welded to the circuit board. Because there aren't any large flat surfaces on the electrical connector, an absorbed cover is usually installed on the electrical connector to make the vacuum-absorbing device easily absorb the electrical connector. The absorbed cover is located on the metal cover and has a flat surface and is absorbed by the vacuum-absorbing device. Because the absorbed cover is installed on the metal cover, the absorbed cover cannot be assembled onto the metal cover if the structure is modified. A new absorbed cover needs to be developed. The manufacturing cost is therefore increased. Furthermore, due to the inadequate spring force of a wedged-hook located on the absorbed cover, the wedged-hook is easily broken so as to destroy the absorbed cover after the wedged-hook is used many times.

SUMMARY OF THE INVENTION

One particular aspect of the present invention is to provide a buckling structure. When the buckling structure is assembled, the absorbed cover is not damaged.

Another particular aspect of the present invention is to provide an electrical connector element. When the electrical connector element is assembled, the absorbed cover is not damaged.

The buckling structure includes a buckling part having a buckling point. There is a waving point located in the inside of the buckling point. The buckling point rotates with the waving point to be operated between a buckling status and an opening status.

The electrical connector element includes an electrical connector and an absorbed cover assembled on the electrical connector. The absorbed cover has a first wedged-hook that is wedged and fastened to the electrical connector. The first wedged-hook includes a buckling part having a buckling point. There is a waving point located in the inside of the buckling point. The buckling point rotates with the waving point to be operated between a buckling status and an opening status.

The buckling structure and an electrical connector element using the same increases the spring force of the wedged-hook. Therefore, the absorbed cover is not damaged during the assembly process.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
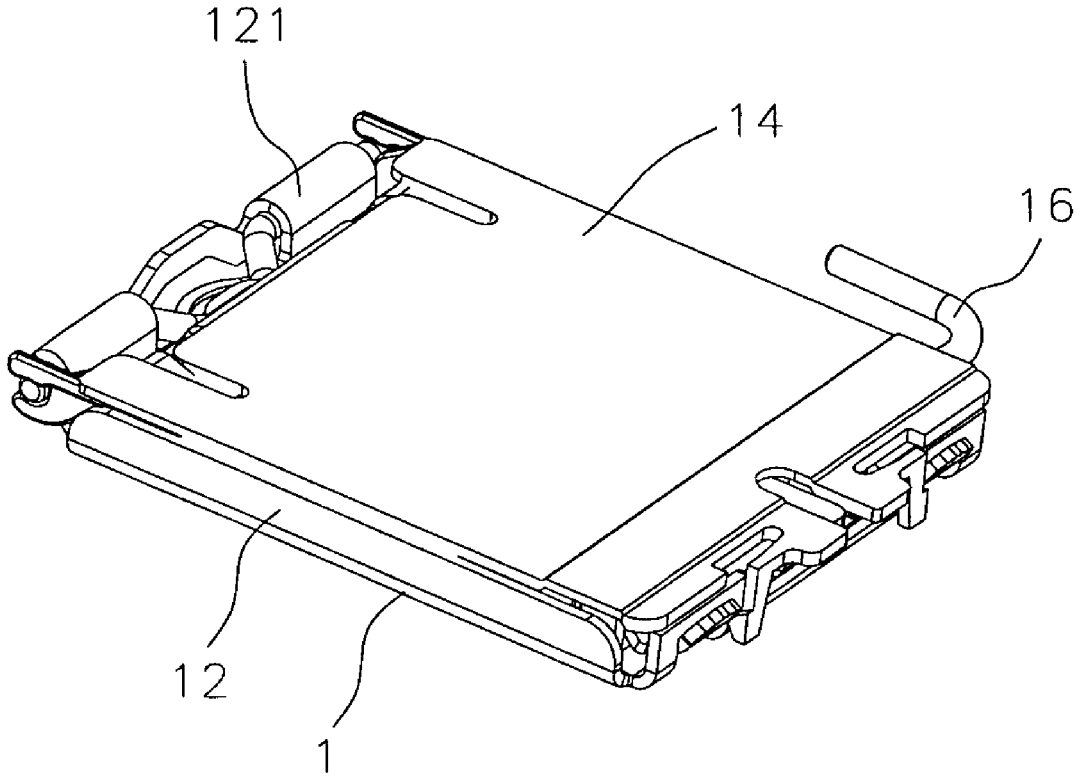
FIG. 1 is an assembly perspective view of the electrical connector element of the present invention.
Figure 2:
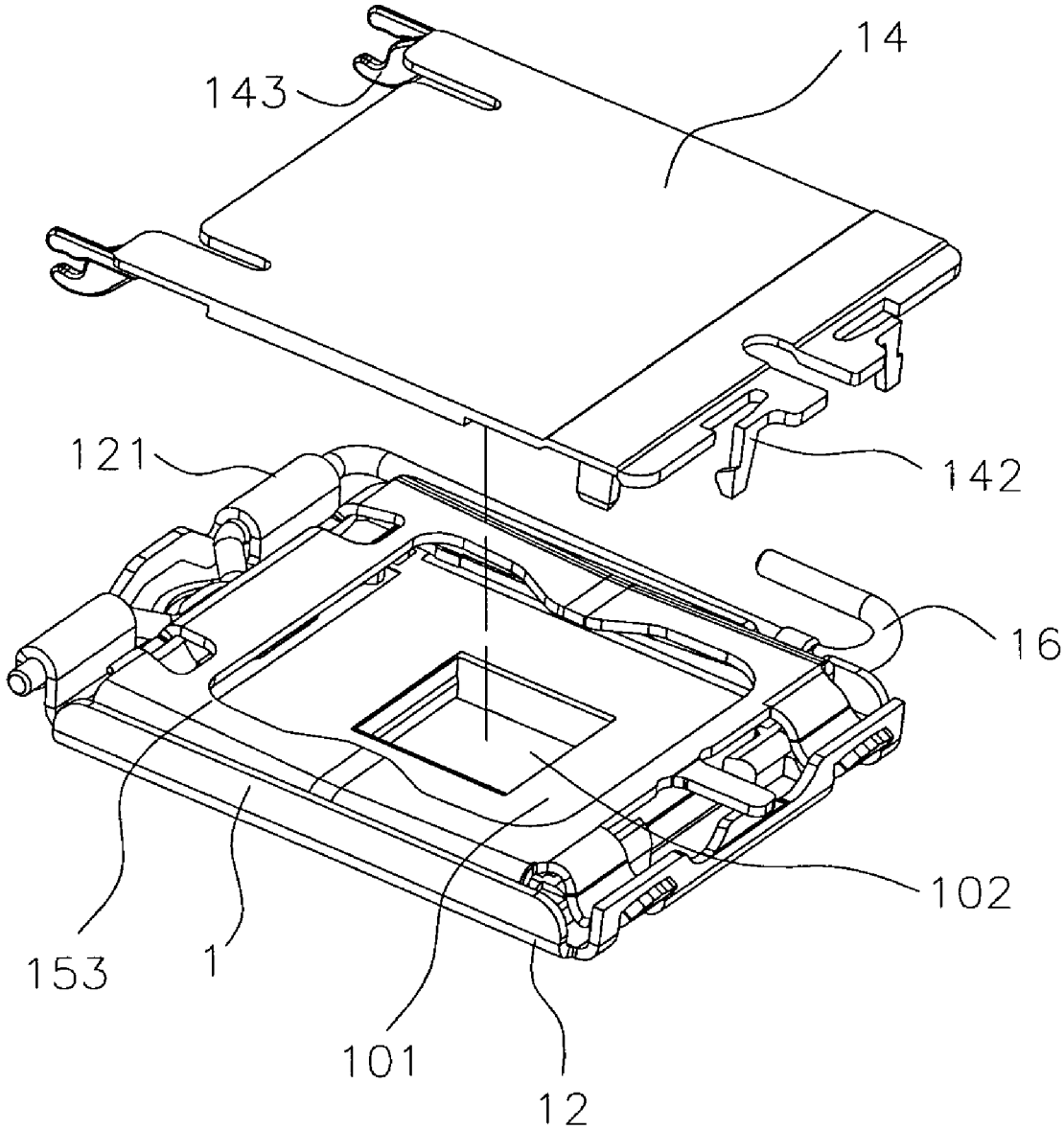
FIG. 2 is an exploded perspective view of the electrical connector and the absorbed cover of the present invention.
Figure 3:
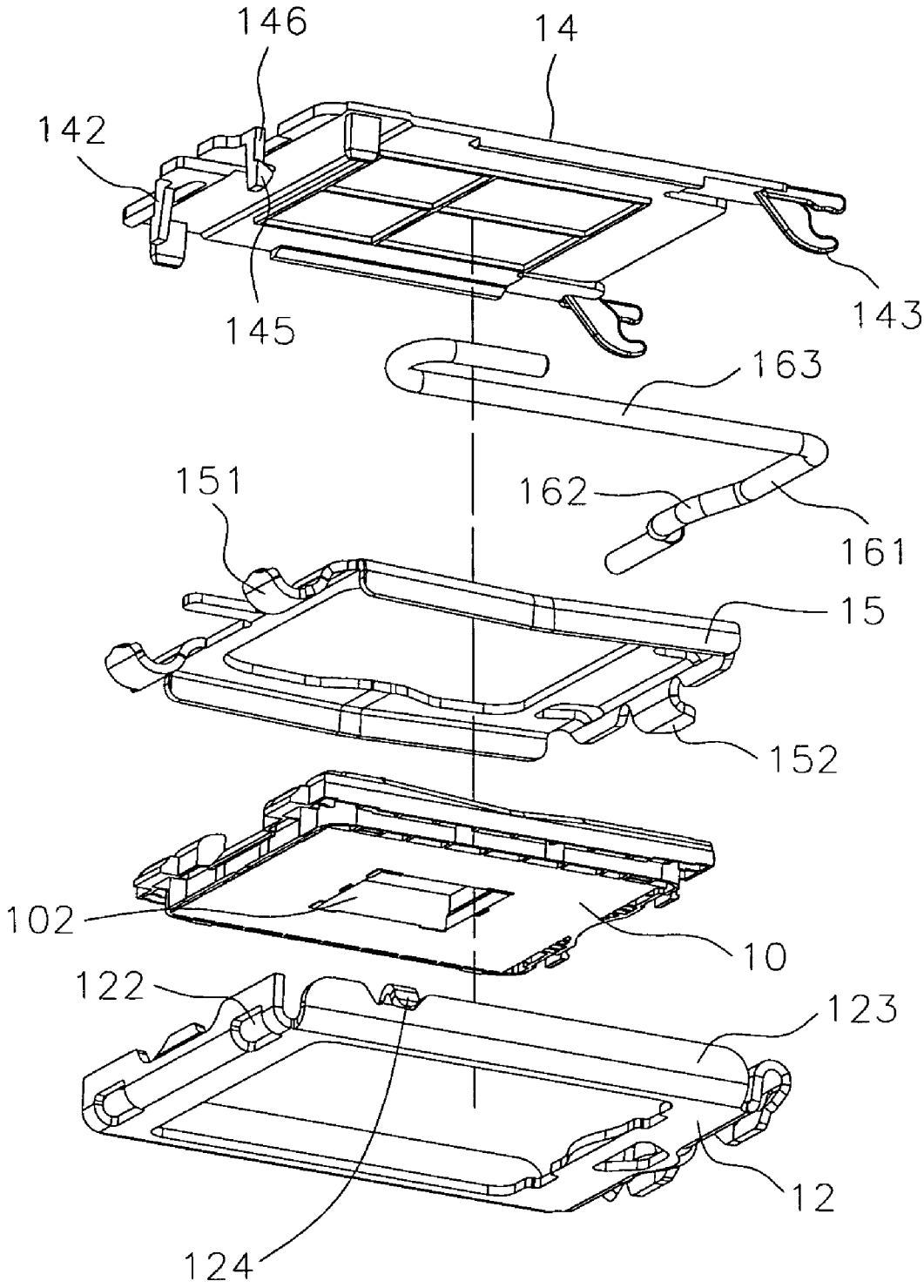
FIG. 3 is an exploded perspective view of the electrical connector element of the present invention.
Figure 4:
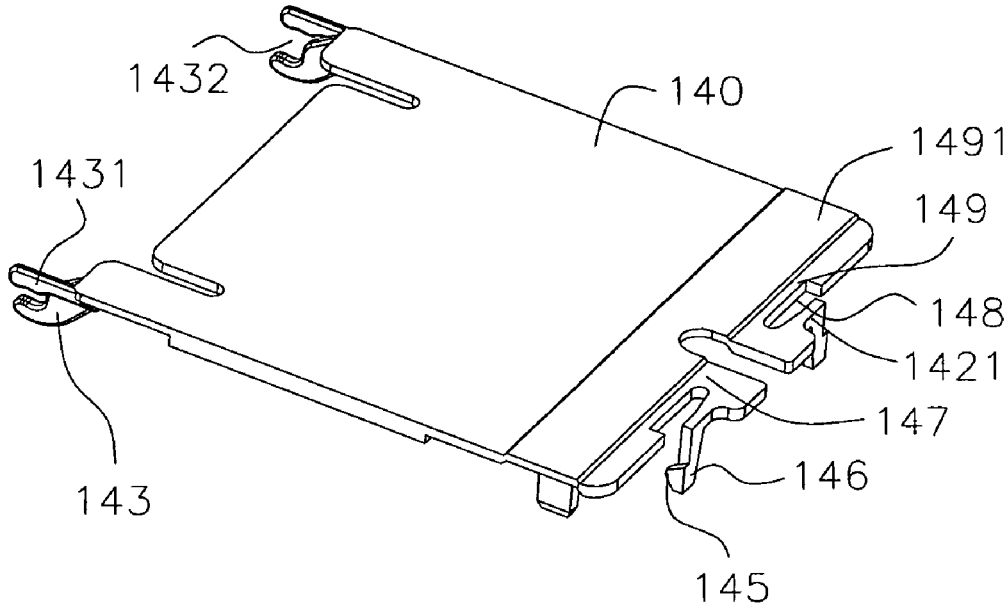
FIG. 4 is a perspective view of the absorbed cover of the electrical connector element of the present invention.

The electrical connector element of the present invention is illustrated by referring to the attached diagrams and the preferred embodiment.

Reference is made to FIGS. 1 to 4. The electrical connector element of the present invention is used for connecting with a chip module (not shown in the figure). The electrical connector element includes an electrical connector 1 and an absorbed cover 14 assembled on the electrical connector 1. The electrical connector 1 includes an insulating body 10, conducting pins (not shown in the figure), and a buckling base 12. At two ends of the buckling base 12, a cover body 15, used for pressing the chip module, and a rod 16, used for pressing the cover body 15 onto the buckling base 12, are pivoted.

On the insulating body 10, there is a carrying part 101 for carrying the chip module (not shown in the figure). On the carrying part 101, there are a plurality of receiving holes (not shown in the figure) for receiving the conducting pins (not shown in the figure). There is a square hole 102 located at the middle location of the insulating body 10.

The buckling base 12 has a square-frame shape, and the insulating body 10 is received in the buckling base 12. A wedged-holding part 121 bends outward from one side of the buckling base 12 and is used for being pivoted with the rod 16. A through slot 122 is located at another side opposite to the wedged-holding part 121 and can be movably connected with the cover body 15. The width of the through hole 122 is larger than the width of the connection side of the cover body 15. On another two sides of the buckling base 12, without the wedged-holding part 121 and the through hole 122, there are blocking walls 123. A buckling part 124 is formed by bending the buckling part 124 outward from one blocking wall 123 so that it buckles with the rod 16.

The cover body 15 has a frame structure that has a through hole in the middle. On the cover body 15, there is a pivoting end 151 fitted with the through slot 122. There is a buckling end 151 located at another end that is opposite to the pivoting end 151 and extends outward. When the rod 16 is closed, the buckling end 152 presses on the buckling base 12. There is a frame 153 on the cover body 15 for pressing the chip module on the carrying part 101 of the insulating body 10.

The rod 16 includes two pivoting parts 161 pivoted with the wedged-holding part 121 of the buckling base 12, a pressing part 162 that extends inward from the two pivoting parts 162, and an operating part 163 that extends vertically from an outside of one pivoting part 162.

The absorbed cover 14 includes a body 140 that has a flat surface on its upper surface, and a waving part 1491 that can deform. On one side of the absorbed cover, there is a first wedged-hook 142 that can wedge and fasten to the electrical connector 1. On an opposite side, there is a second wedged-hook 143 that can fasten onto the rod 16. The first wedged-hook 142 includes a buckling part 146 having a buckling point 145. There is a waving point 147 located in an inside of the buckling point 145. The buckling point 145 rotates with the waving point 147 to be operated between a buckling status and an opening status for assembling or disassembling the absorbed cover 14. The waving point 147 is located on the waving part 1491. The width of a connection area between the first wedged-hook 142 and the body 140 is smaller than the width of the body 140. There is a concave slot 149 on the first wedged-hook 142. The waving point is formed on the concave slot 149. The thickness of the waving part 1491 on the waving location is smaller than the thickness of the main body of the waving part 1491. There is a slot 148 located between the first wedged-hook 142 and the absorbed cover 14 so that the first wedged-hook 142 has a longer flexible arm 1421. The buckling part 146 can buckle with the upper edge of the through slot 122 of the buckling base 12. There is a turning part extending forward from the main body of the waving part 1491 that can rotate the first wedged-hook 142 for assembling or disassembling the absorbed cover 14. The second wedged-hook 143 extends downward and outward from the body 140. There is a blocking part 1431 that extends from the body 140 and is adjacent to the second wedged-hook 143. The blocking part 1431 and the second wedged-hook 143 form a receiving space 1432 for receiving the rod 16. The receiving space 1432 has a circular shape and a smaller opening. The receiving part 1432 can be fastened to the outside of the two pivoting parts 161 of the rod 16.

Because the first wedged-hook 142 and the second wedged-hook 143 extend downward from two sides of the absorbed cover 14, the first wedged-hook 142 buckles into the through slot 122 of the buckling base 12 and the second wedged-hook 143 buckles with the outside of the two pivoting parts 161 of the rod 16. Thereby, the absorbed cover 14 is not buckled directly on the cover body 15 thereby avoiding the problem that the absorbed cover cannot be assembled onto the cover body when its structure is modified (or without the cover body) and a new absorbed cover needs to be developed. The developing cost is therefore reduced and the absorbed cover can be applied to a variety of electrical connectors. Moreover, the spring force of the wedged-hook is increased so that the absorbed cover is not damaged during the assembly process.

Figure 5:
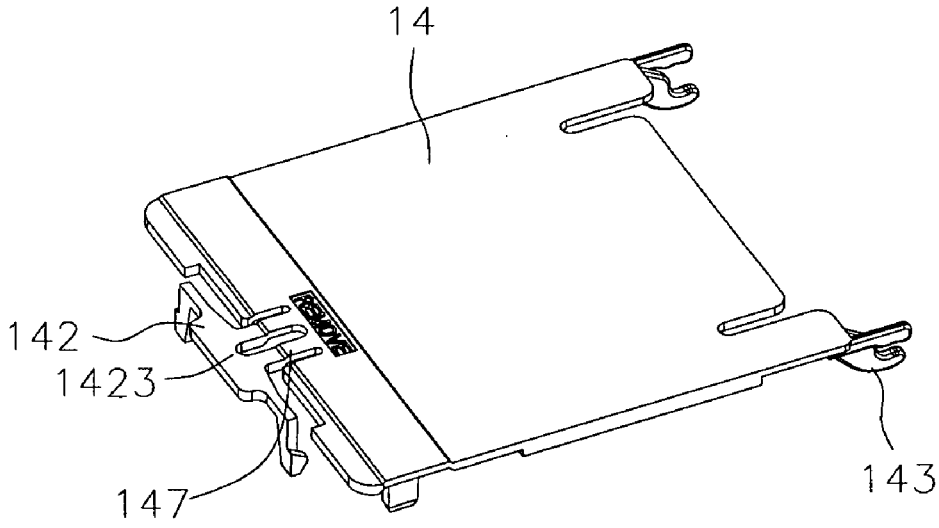
FIG. 5 is a perspective view of another embodiment of the electrical connector element of the present invention.
Figure 6:
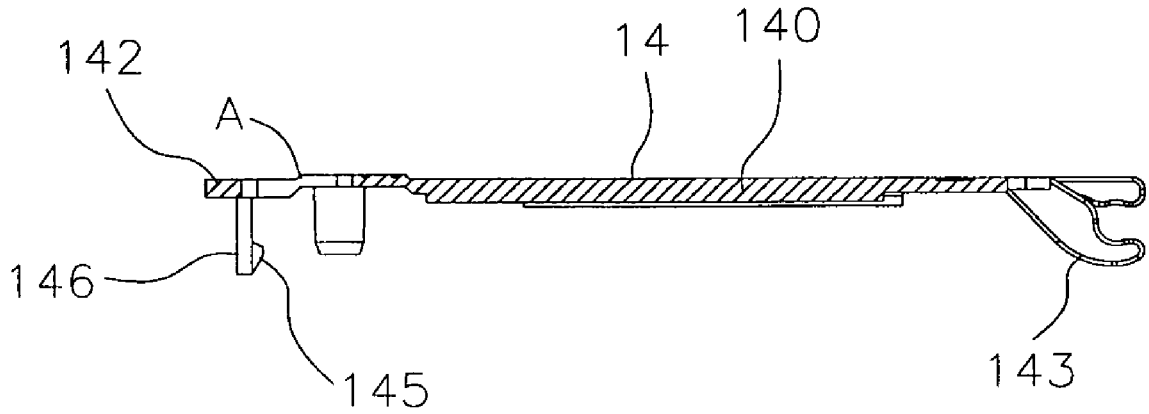
FIG. 6 is a cross-sectional view of FIG. 5

Reference is made to FIG. 5 and FIG. 6, which show the second embodiment of the present invention. The difference between the second embodiment and the first embodiment is that there is an area A on the first wedged-hook 142 and the thickness of the area A is smaller than other area of the first wedged-hook 142. The waving point 147 is formed on the area A and there is a connecting part 1423 between the two first wedged-hooks 141 of the absorbed cover 142. It has the function of dragging with each other to enhance the spring force so as to achieve the same effect as the first embodiment.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector element, comprising:

an electrical connector; and an absorbed cover assembled on the electrical connector;

wherein the absorbed cover has a first wedged-hook that wedges and fastens to the electrical connector, the first wedged-hook comprises a buckling part having a buckling point, there is a waving point located in the inside of the buckling point, and the buckling point rotates with the waving point to be operated between a buckling status and an opening status.

2. The electrical connector element as claimed in claim 1, wherein the width of a connection area between the first wedged-hook and the main body is smaller than the width of the main body, and the waving point is formed at the connection area.

3. The electrical connector element as claimed in claim 2, wherein there is a slot located between the first wedged-hook and the absorbed cover so that the first wedged-hook has a longer flexible arm.

4. The electrical connector element as claimed in claim 1, wherein there is an area on the first wedged-hook and the thickness of the area is smaller than other area of the first wedged-hook, and the waving point is formed on the area.

5. The electrical connector element as claimed in claim 1, wherein the electrical connector comprises a rod, and there is a second wedged-hook located on another opposite end of the absorbed cover and fastened on the rod.

6. The electrical connector element as claimed in claim 1, wherein the electrical connector further comprises an insulating body, conducting pins, a cover body for pressing a chip module, a rod for pressing and fastening the cover body, and a buckling base for receiving the insulating body.

* * * * *